US008099834B2

(12) United States Patent
Corso et al.

(10) Patent No.: US 8,099,834 B2
(45) Date of Patent: Jan. 24, 2012

(54) LOOSE-PIN HINGE AND HINGE PIN WITH INTEGRATED STOP

(76) Inventors: Salvatore Corso, Cherry Hill, NJ (US); Steven Riela, Sewell, NJ (US); Martino Ilacqua, Glassboro, NJ (US); Giovanni Cusati, Sewell, NJ (US)

( * ) Notice: Subject to any disclaimer, the term of this patent is extended or adjusted under 35 U.S.C. 154(b) by 373 days.

(21) Appl. No.: 12/416,206

(22) Filed: Apr. 1, 2009

(65) Prior Publication Data

US 2010/0251520 A1 Oct. 7, 2010

(51) Int. Cl.
*E05D 11/06* (2006.01)

(52) U.S. Cl. ..... 16/374; 16/342; 16/386

(58) Field of Classification Search ..... 16/342, 16/386, 387, 374, 375, 82, 235
See application file for complete search history.

(56) References Cited

U.S. PATENT DOCUMENTS

| | | | | |
|---|---|---|---|---|
| 294,746 | A | 3/1884 | Straup et al. | |
| 1,683,814 | A * | 9/1928 | Block | 16/353 |
| 1,758,309 | A * | 5/1930 | Block | 16/332 |
| 2,533,502 | A * | 12/1950 | Philips | 16/242 |
| 2,930,075 | A | 3/1960 | Deutchman et al. | |
| 3,015,126 | A * | 1/1962 | Ahlgren | 16/386 |
| 3,188,686 | A * | 6/1965 | Orcutt | 16/263 |
| 3,333,294 | A | 8/1967 | Warner | |
| 3,538,539 | A * | 11/1970 | Allison | 16/375 |
| 3,905,065 | A | 9/1975 | Seeger et al. | |
| 3,913,171 | A | 10/1975 | Reid | |
| 4,175,315 | A * | 11/1979 | Hayes et al. | 29/453 |
| 5,408,726 | A | 4/1995 | Kent | |
| 5,765,263 | A * | 6/1998 | Bolinas et al. | 16/342 |
| 6,497,005 | B2 | 12/2002 | Apostoloff | |
| 7,197,791 | B1 | 4/2007 | Smith | |
| 7,891,055 | B1 * | 2/2011 | Combs | 16/342 |

* cited by examiner

*Primary Examiner* — William L. Miller
(74) *Attorney, Agent, or Firm* — Drinker Biddle & Reath LLP

(57) ABSTRACT

A loose-pin hinge with integrated stop includes a first hinge leaf having a knuckle having a bore therethrough and a second hinge leaf including a lower knuckle and an upper knuckle each having a bore therethrough. The lower knuckle and the upper knuckle are interdigitially mated with the knuckle of the first leaf such that the bores of the knuckles are coaxially aligned. The hinge further includes a hinge pin having a shank, a head disposed at an upper end of the shank, and a stop member extending radially outward from the head. The shank of the hinge pin is received through the coaxially aligned bores of the knuckles to enable the first leaf to pivot about the hinge pin with respect to the second leaf, the stop member limiting the pivoting of the first leaf to a maximum pivoting angle with respect to the second leaf.

18 Claims, 9 Drawing Sheets

LOOSE-PIN HINGE AND HINGE PIN WITH INTEGRATED STOP

FIELD

This relates to a stop for a hinge, such as a door hinge. More particularly, it relates to a hinge pin with an integral stop for use in a loose-pin type hinge, and methods for use of same.

BACKGROUND

A problem with the use of existing loose-pin hinges is the requirement for a separate stop to limit the range of angular movement of a hinged member such a door that pivots about the hinge. If a stop is not provided, walls, doors, and hinges all can be damaged by unintentional impact when the door is opened fully. To limit the effects of such impact, traditional door stops are typically mounted in the floor, or attached to baseboards, or the wall itself. Those stops are generally aesthetically unpleasing. They can be particularly visually disruptive to the architectural features of a finely-crafted door and doorway. Traditional stops can have other undesired effects, e.g., they can present a physical obstacle, such as a tripping hazard, interfere with routine cleaning, and cause physical or aesthetic damage to architectural millwork, such as molding.

Solutions that attempt to deal with the problems presented by traditional door stops include using wall plates or bumpers, door handle pads, and hinge-integrated stops. In the case of wall plates and door-handle pads, while they overcome some of the problems associated with floor-mounted door stops, they are equally problematic in terms of aesthetics. In some cases, such devices are more visually intrusive than floor-mounted stops. In addition, because those devices do not limit the range of movement of the door, they are intended merely to absorb the impact against the wall. Thus, the use of such devices does not prevent noise, and damage can still result to the door, door handle, wall, or wall plate. In the case of hinge-integrated stops, devices that have thus far been available either do not function well, or do not solve the aesthetic problem because they, too, are not visually pleasing, particularly when the door is closed.

In some cases, existing designs for integrated door stops require expensive or complicated hardware. In other cases, hinge-integrated stops are not conveniently adjustable by an end-user, such as a home owner. Moreover, hinge-integrated stops may be prone to failure due, e.g., to repeated impact between the stop, the door, and the wall. Further, they may involve installation procedures that are not familiar to most craftsmen, and are too complex for a "do-it-yourselfer."

SUMMARY

Loose-pin type hinges featuring an integrated and adjustable stop are disclosed. The hinges are conveniently used with doors and other hinged members, and provide enhanced aesthetics, especially for finely crafted doors where conventional door stops can detract from the craftsmanship and beauty of the door and the surrounding moulding.

In one embodiment of the invention, a loose-pin hinge with integrated stop is provided. The hinge includes a first hinge leaf with a knuckle having a bore therethrough and a second hinge leaf with a lower knuckle and an upper knuckle each having a bore therethrough. The lower knuckle and the upper knuckle are interdigitially mated with the knuckle of the first hinge leaf such that the bores of the knuckles are coaxially aligned. The hinge further includes a hinge pin having a shank, a head disposed at an upper end of the shank and a stop member extending radially outward from the head. The shank of the hinge pin is received through the coaxially aligned bores of the knuckles to enable the first hinge leaf to pivot about the hinge pin with respect to the second hinge leaf, the stop member limiting the pivoting of the first hinge leaf to a maximum pivoting angle with respect to the second hinge leaf.

In another embodiment of the invention, a loose-pin hinge with integrated stop is provided. The hinge includes a first hinge leaf with a knuckle having a generally cylindrical bore therethrough and a second hinge leaf with a lower knuckle having a generally cylindrical bore therethrough and an upper knuckle having a bore therethrough. In addition, the upper knuckle has an engaging formation. The lower knuckle and the upper knuckle are interdigitially mated with the knuckle of the first hinge leaf such that the bores of the knuckles are coaxially aligned. The hinge further includes a hinge pin having a shank, a head disposed at an upper end of the shank, an engaging member disposed along an upper portion of the shank, and a stop member extending radially outward from the head, the shank of the hinge pin being received through the coaxially aligned bores of the knuckles to enable the first hinge leaf to pivot about the hinge pin with respect to the second hinge leaf. The engaging member of the hinge pin engages with the engaging formation of the upper knuckle to set an angular position of the hinge pin with respect to the second hinge leaf, and the stop member of the hinge pin limits the pivoting of the first hinge leaf to a maximum pivoting angle with respect to the second hinge leaf, the maximum pivoting angle being determined as a pivoting angle between the first hinge leaf and the second hinge leaf at which the stop member contacts the first hinge leaf.

In another embodiment of the invention, a method is provided for limiting a hinge pivoting angle. The method includes providing hinge having a first hinge leaf, a second hinge leaf, and a hinge pin. The first hinge leaf includes a knuckle having a generally cylindrical bore therethrough, and the second hinge leaf includes a lower knuckle having a generally cylindrical bore therethrough and an upper knuckle having a bore therethrough. The upper knuckle further has an engaging formation. The lower knuckle and the upper knuckle are adapted to be interdigitially mated with the knuckle of the first hinge leaf such that the bores of the knuckles are coaxially aligned. The hinge pin includes a shank, a head disposed at an upper end of the shank, an engaging member disposed along an upper portion of the shank, and a stop member extending radially outward from the head. The method further includes aligning an edge of the stop member with a desired maximum pivoting angular position of the first hinge leaf with respect to the second hinge leaf, and inserting the shank of the pin through the coaxially aligned bores of the knuckles so that the engaging member of the pin engages with the engaging formation of the upper knuckle at an angular position that retains the edge of the stop member nearest to the desired maximum pivoting angular position.

In another embodiment of the invention, a hinge pin is provided for limiting the pivoting angle between a first hinge leaf and a second hinge leaf in a conventional hinge to a desired maximum pivoting angle. The hinge pin includes a shank, a head disposed at an end of the shank, and a stop member extending radially outward from the head. The stop member spans a stop member angle that is complementary to the desired maximum pivoting angle such that the stop member contacts a face of the first leaf and a face of the second leaf when the pivoting angle is equal to the desired maximum pivoting angle.

DETAILED DESCRIPTION

Disclosed herein are embodiments of a loose-pin hinge comprising an integrated stop that is conveniently adjustable. A stop member is affixed to the hinge pin, and optionally, a mating stop member can be affixed to one or more hinge leaves. The loose-pin hinges disclosed herein provide many advantages over existing hinges and stops for use therewith. In certain embodiments, the hinges disclosed herein provide improved performance and/or aesthetics, and are particularly useful in settings where conventional stop members lack adequate adjustability or are deemed undesirable.

Figure 1:
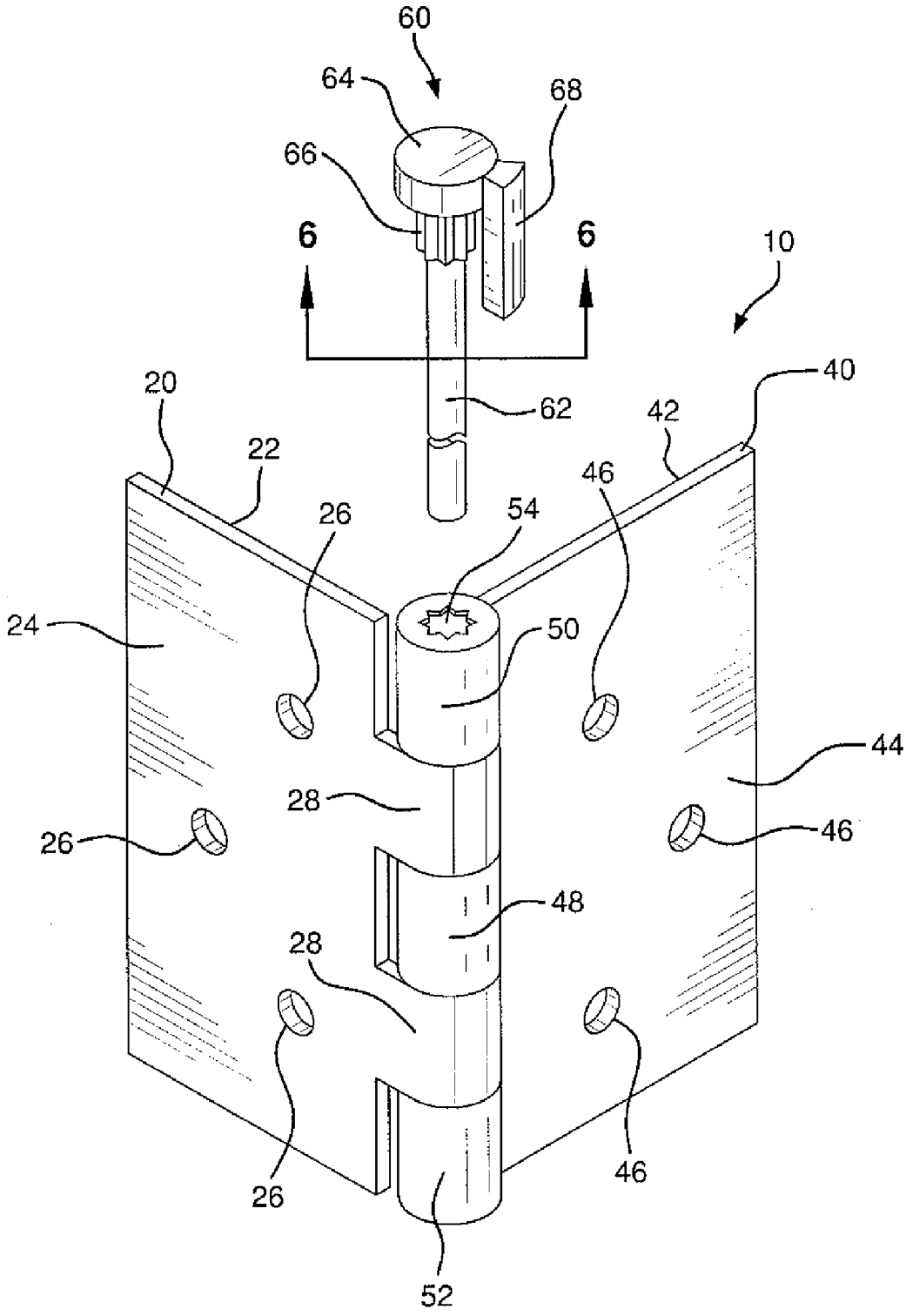
FIG. 1 is a partially exploded perspective view showing an embodiment of a loose-pin hinge with integral stop.
Figure 3:
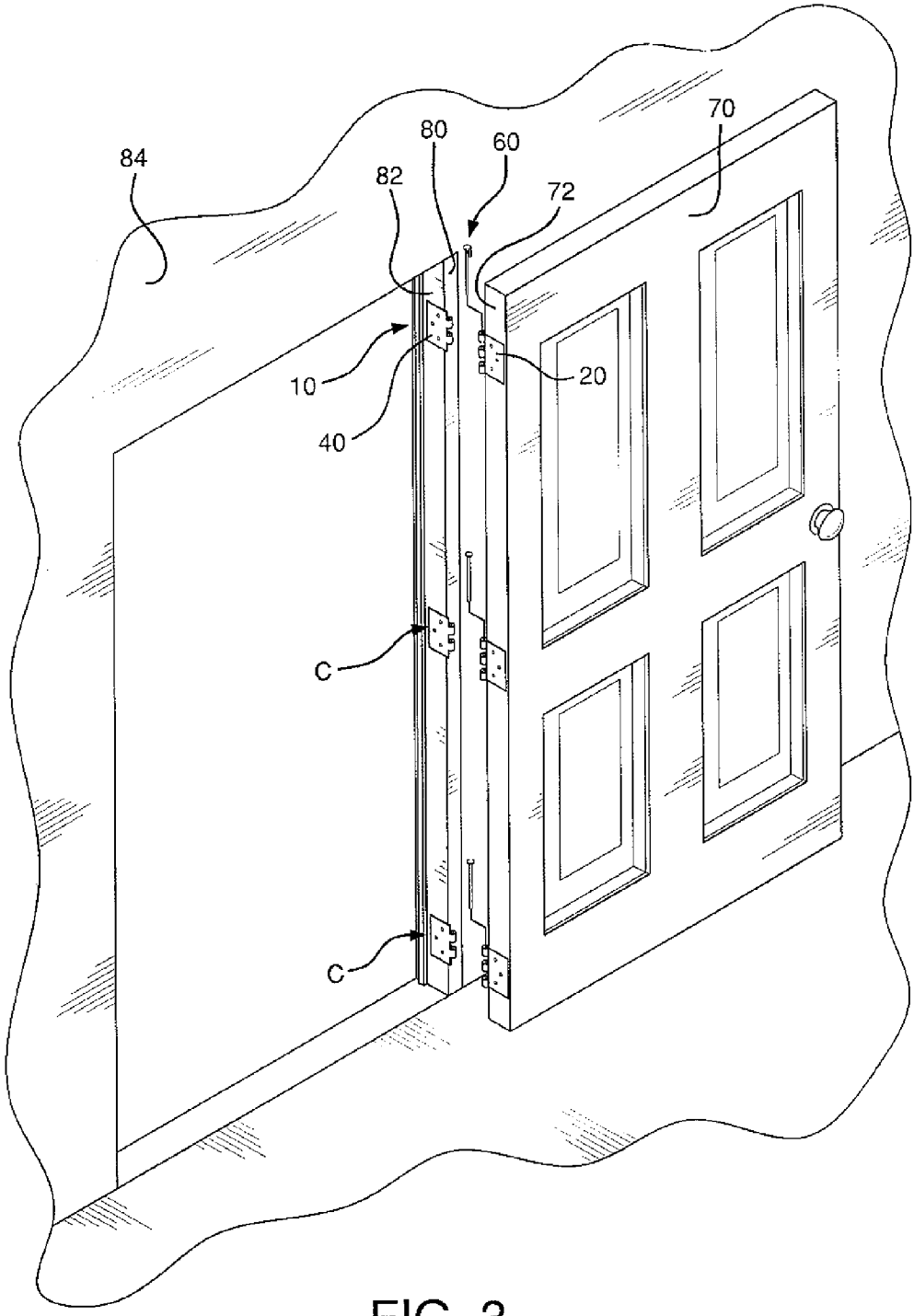
FIG. 3 is a partially exploded perspective view showing an embodiment of a loose-pin hinge with integral stop mounted to a door frame and door, in combination with conventional hinges, with the door disposed in an open position to show the inner faces of the hinge leaves.

There is shown in FIG. 1 an embodiment of a loose-pin hinge 10 comprising a first leaf 20 and a second leaf 40 pivotably interconnected by a hinge pin 60. The first leaf 20 has an outer face 22 and an inner face 24, and a plurality of holes 46 each adapted to receive a fastener for mounting the first leaf 20 to a first pivoting member such as a door jamb. For example, FIG. 3 the hinge 10 mounted as an upper hinge between a door jamb 80 and a door 70. (Note that the hinge 10 can be mounted as any one or more of the hinges supporting a door 70 from a door jamb 80. As shown in FIG. 3, the hinge 10 is used in combination with two conventional hinges C.) In particular, FIG. 3 shows the first leaf 20 mounted to a surface 82 of the door jamb 80 with the outer face 22 abutting a mortise in the door jamb 80 and the inner face 24 facing toward the second leaf 40. The second leaf 40 has an outer face 42 and an inner face 44, and a plurality of holes 46 each adapted to receive a fastener for mounting the second leaf 40 to a second pivoting member such as a door. For example, FIG. 3 shows the second leaf 40 mounted to the door 70 with the outer face 42 abutting a mortise in an edge 72 the door 70 and the inner face 44 facing toward the first leaf 20. Once the second leaf 40 is mounted to the door 70, the first leaf 20 is mounted to the door jamb 80, and the hinge pin 60 pivotably connects the first and second leaves 20, 40 to each other, the door 70 can be pivoted about the hinge pin 60 with respect to the door jamb 80. Note that alternatively, the hinge 10 can be arranged so that the first leaf 20 is mounted to the door 70 and the second leaf 40 is mounted to the door jamb 80.

The angle between the inner faces 22, 42 of the first and second leaves 20, 40, respectively, is substantially equal to the angle between the edge 72 of the door 70 and the surface 82 of the door jamb 80. Thus, when the door 70 is closed so that the inside edge 72 is disposed directly opposite from and substantially parallel to the surface 82 of the door jamb 80, the outer face 22 of the first leaf 20 and the outer face 42 of the second leaf 42 are disposed directly opposite from and substantially parallel to each other. Further, for example, when the door 70 is open to about 90° with respect to the door jamb 80, the outer face 22 of the first leaf and the outer face 42 of the second leaf are disposed at about 90° apart with respect to each other. Typically, because the door jamb 80 is affixed to a wall 84, the maximum pivoting angle of the door 70 is about, or somewhat larger than, 180°. (It is understood that when the door 70 becomes parallel to a wall 84 to which the door jamb 80 is installed, the opening angle of the door 70 is about 180°, and that depending on the distance by which the center of the pin 60 is offset from the wall 84, the door 70 may be positioned at an angle somewhat greater than 180°, and typically as great as about 200°, before contacting the wall 84.)

The first leaf 20 has at least one knuckle 28 extending therefrom, each knuckle 28 having a generally cylindrical bore therethrough (not shown) for slidably receiving the pin 60. In the embodiment depicted in FIG. 1, the first leaf 20 has two knuckles 28. The knuckles 28 are preferably substantially similar to those used on conventional hinges. The second leaf 40 has at least two knuckles extending therefrom. In the embodiment depicted in FIG. 1, the second leaf 40 has three knuckles, including a middle knuckle 48 and a lower knuckle 52 each having a generally cylindrical bore therethrough (not shown), and an engaging upper knuckle 50 also having bore therethrough. The bores through the knuckles 28, 48, 50, and 52 are adapted to snugly receive a shank 62 of the hinge pin 60. At least a portion of the bore in the upper knuckle 50 includes an engaging formation 54 adapted to engage with an engaging member 66 on the hinge pin 60, as discussed below. The knuckles 48, 52 are preferably substantially similar to those used on convention hinges.

In another embodiment of the hinge 10 (not shown), the second leaf 40 has only two knuckles, including one lower knuckle 52 and one upper engaging knuckle 50, and the first leaf 20 has only one knuckle 28 interposed between the knuckles 50, 52 of the second leaf 40. In another embodiment of the hinge 10 (not shown), such as for use in high end doors, the first leaf 20 has three knuckles 28 and the second leaf has four knuckles, including an upper knuckle 50, two middle knuckles 48, and a lower knuckle 50.

In another embodiment of the hinge 10, the lower knuckle 52 is a second engaging knuckle 52 having an engaging formation 54 the same as that contained in the upper engaging knuckle 50 and adapted to engage with the engaging member 66 on the hinge pin 60. In this embodiment, as is the case with conventional hinges, the loose-pin hinge 10 can be used with either left-opening or right-opening arrangements by inverting the hinge 10, as required, because each of the upper (inverted lower) knuckle 50 and the lower (inverted upper) knuckle 52 includes an engaging formation 54 for mating with the engaging member 66 of a pin 60.

As depicted in FIG. 1, the hinge pin 60 includes a pin shank 62, a pin head 64 affixed to an upper end of the shank 62, an engaging member 66 extending along an upper portion of the pin shank 62, and a stop member 68. The stop member 68 projects radially outward from the pin head 64, as shown generally in FIGS. 7A through 7F. The stop member 68 can further project downwardly from the head 64 in a direction generally parallel to the shank 62. When the hinge 10 is fully assembled, the pin shank 62 passes sequentially through the bores in the knuckles 50, 28, 48, 28, 52, the pin head 64 rests on top of the upper knuckle 50, and the engaging member 66 engages the engaging formation 54 in the upper knuckle 50 so that the pin 60 rotates with the door 70 as the door 70 pivots about the axis of the pin 60. Note that in an alternate arrangement wherein the first hinge 20 is mounted to the door 70 and the second hinge 40 is mounted to the door jamb 80, the pin remains stationary with the door jamb 80 as the door 70 pivots about the pin 60.

The pin head 84 can be similar in thickness to the head of a standard hinge pin. In one embodiment, the pin head 84 is thicker than the head of a standard hinge pin (i.e., it has a larger dimension in the axial direction of the pin 60) in order to provide for a larger attachment area of the stop member 68, to ensure that the stop member 68 will remain affixed to the pin head 64 under the load imposed by the stop member 68 coming into contact with the inner face 22 of the first hinge plate 20.

The hinge 10 is assembled as follows. First, the bores of the knuckles 28 on the first leaf 20 are substantially coaxially aligned with the bores of the knuckles 48, 50, 52 on the second leaf 40. In particular, the knuckles are interdigitally mated in an alternating order from leaf to leaf, as shown in the figures and known in the art. Next, the pin 60 is inserted to adjoin the first leaf 20 and the second leaf 40. In particular, the shank 62 is inserted so as to extend through the engaging formation 54 and then successively through the bores of the knuckles 50, 28, 48, 28, 52. The length of the shank 62 is approximately equal to the height of the second leaf 40 from an upper edge of the upper knuckle 50 to a lower edge of the lower knuckle 52. When the pin 60 is fully inserted, the shank 62 is pivotable within the bores of the knuckles 28 on the first leaf 20, while the engaging member 66 of the pin 60 engages the engaging formation 54 of the knuckle 50 so that the pin 60 is substantially rotationally fixed, or not pivotable, with respect knuckles 48, 50, and 52, and thus with respect to the second leaf 40.

The respective shapes of the engaging member 66 and the engaging formation 54 are matched as male and female mating parts, respectively. In particular, the engaging member 66 of the hinge pin 60 has a male geometric shape and the engaging formation 54 of the upper knuckle 50 has a mating female geometric shape adapted to engagingly receive the male geometric shape of the engaging member 66. The geometric shape has a number of facets equally spaced about the circumference thereof to enable the hinge pin to be received through the knuckles in a respective number of angular positions to enable adjustment of a maximum pivoting angle between the first and second leaves 20, 40.

The engaging member 66 and the engaging formation 54 can have nearly any geometric shape that is not cylindrical. In one embodiment, the geometric shape is generally either in the form of an x-polygon or an x-spline each having x facets, although any geometric shape with a regularly recurring circumferential feature can be used. (An x-polygon refers to a regular polygon having x sides, e.g., a square is a four-sided polygon having four facets, a hexagon is a six-sided polygon having six facets, and an octagon is an eight-sided polygon having eight facets. An x-spline refers to a regular spline or star-shape having x facets, each facet including one lobe and one trough disposed between adjacent lobes, the facets being equally spaced around the spline; the peaks and troughs of the spine can be substantially pointed or substantially rounded off.) For example, the geometric shape can be an eight-pointed star (FIGS. 6A, 6C, 6E, 6F), a hexagon (FIG. 6B), and a twenty-faceted spline (FIG. 6D). Of course, the engaging member 66 and the engaging formation 54 can have other shapes not depicted, such as those of a square, an octagon, a spline or star having any number of facets, and oval, a circle having a plurality of equally circumferentially spaced tabs extending outwardly therefrom, and an infinite number of additional alternative shapes, as would be understood to one skilled in this art.

Figure 4:
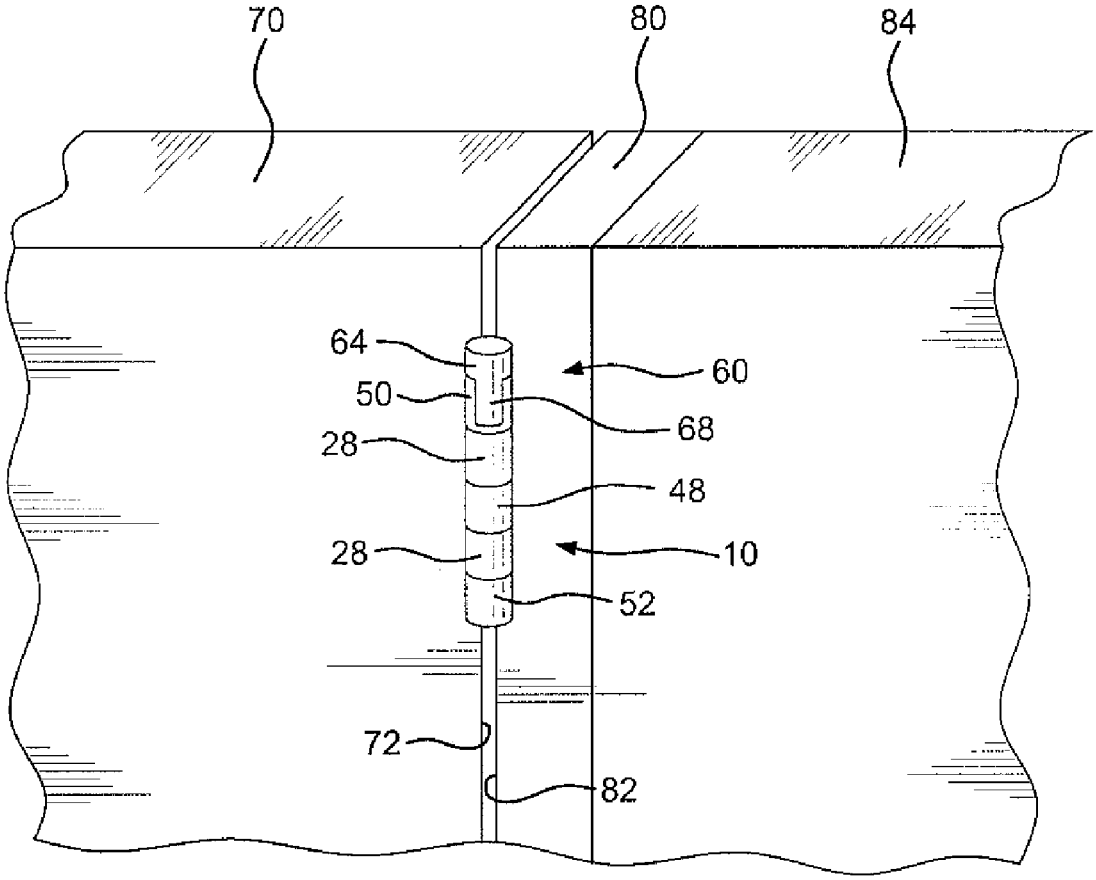
FIG. 4 is an expanded partial front view showing an embodiment of a loose-pin hinge with integral stop mounted to a door frame and door with the door disposed in a closed position.
Figure 5A:
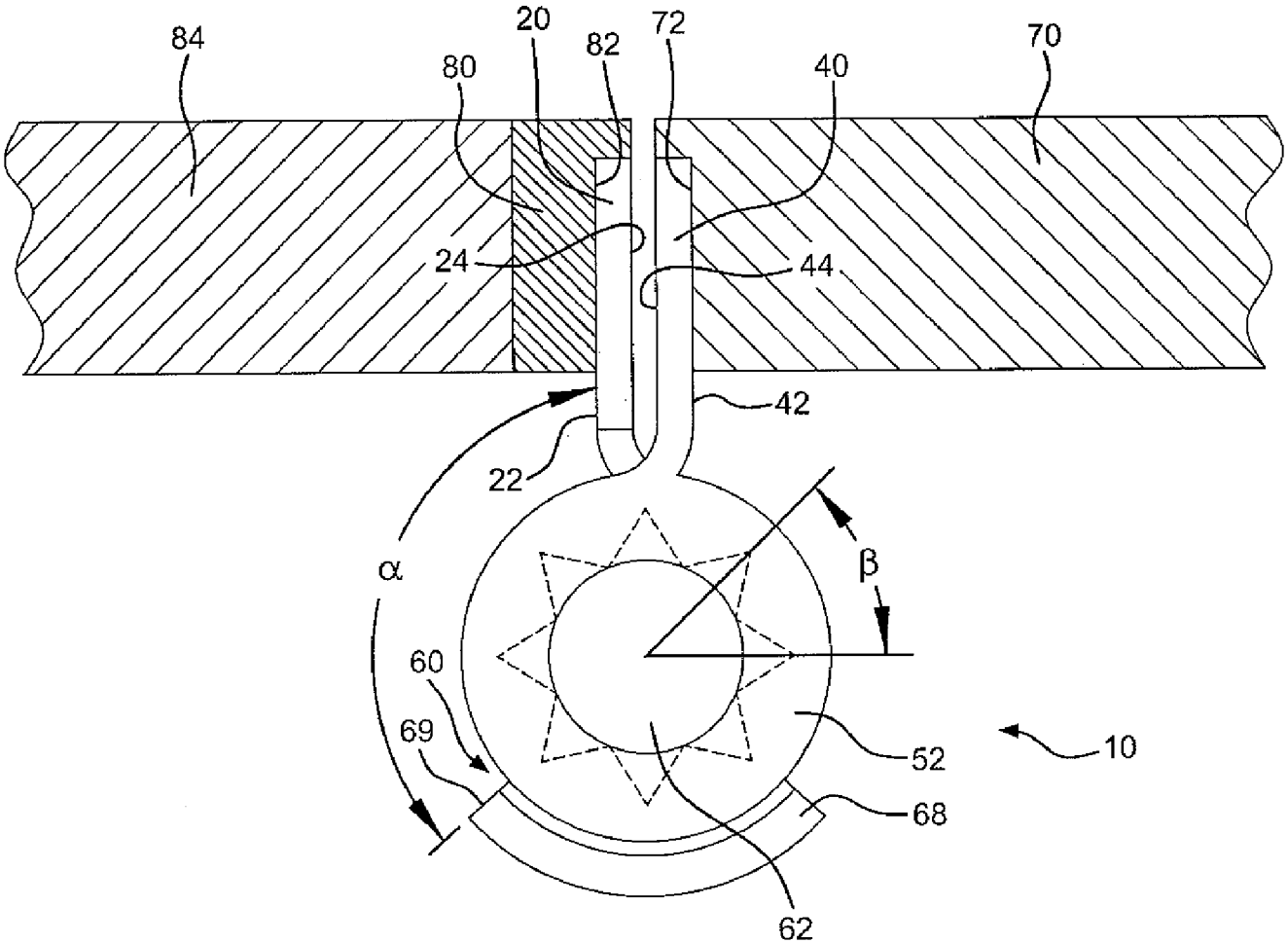
FIG. 5A is an expanded partial cross-sectional view of the embodiment of a loose-pin hinge with integral stop as in FIG. 4, with the door disposed in a closed position.
Figure 5B:
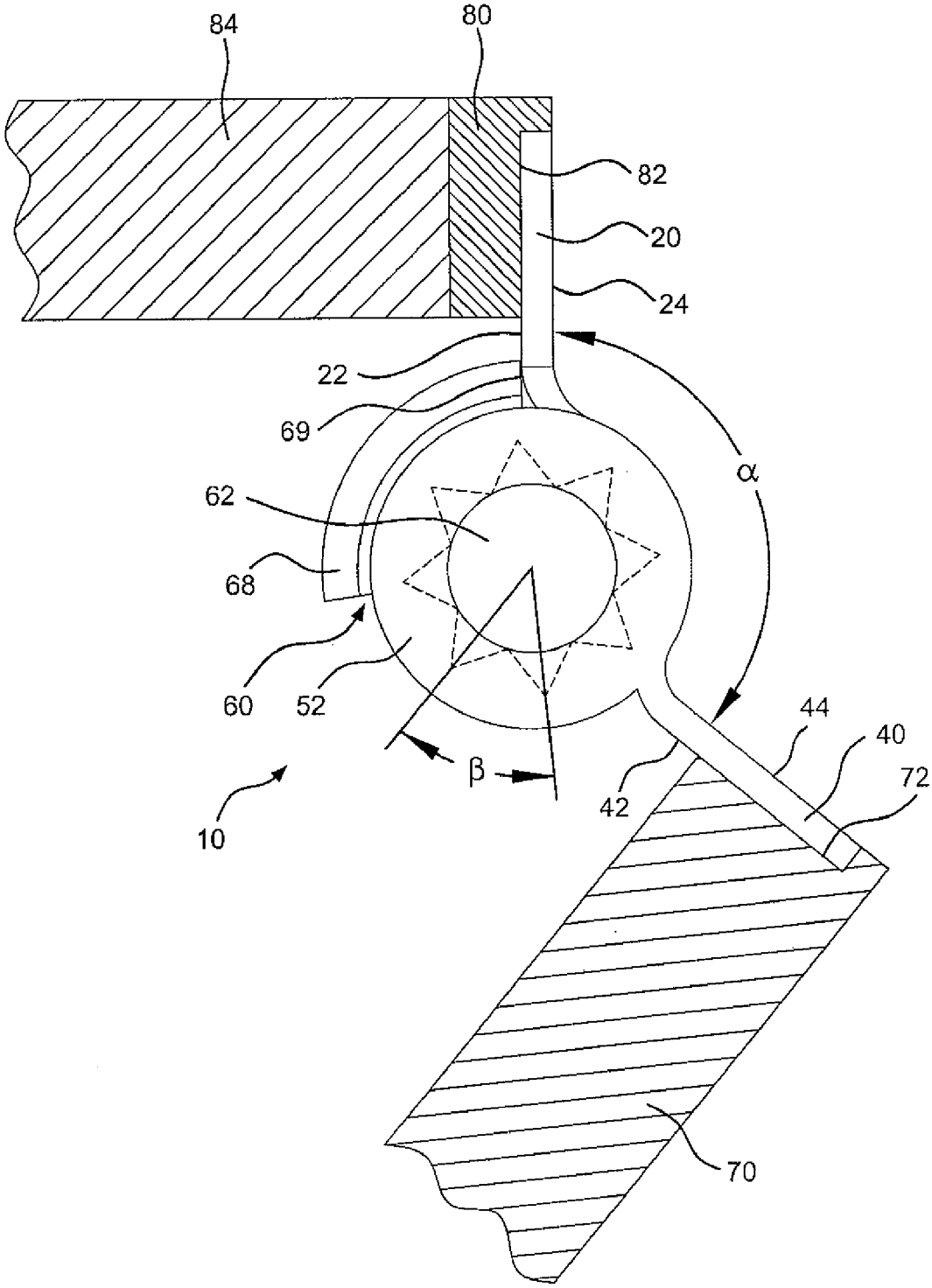
FIG. 5B is an expanded partial cross-sectional view of the embodiment of a loose-pin hinge with integral stop as in FIG. 4, with the door disposed in at a maximum pivoting angle as limited by a stop member according to the present invention.

When the hinge 10 is assembled, the stop member 68 is disposed in the angular space between the inner face 24 of the first leaf 20 and the inner face 44 of the second leaf 40, as shown in FIGS. 4, 5A, and 5B. FIGS. 4 and 5A depict a situation wherein the door 70 is in a fully closed position so that the door 70 is substantially parallel to the wall 84. In this situation, the angle between the inner faces 22, 42 is about 0° and the angle between the outer faces 24, 44 is correspondingly about 360°. In FIG. 5A it can be seen that the pin 60 can be rotationally positioned with respect to the second leaf 40 in a number of angular positions corresponding to the number of facets in the mating pair of the engaging member 66 and the engaging formation 54. The angular difference $\beta$ between each such position is determined by dividing 360° by the number of facets. For example, as shown in FIGS. 5A, 6A, 6C, 6E, and 6F, the eight-pointed star shape permits the pin 60 to be placed in any one of eight positions, each separated by an angle $\beta$ of 45°. In another example, using a hexagonal mating pair as shown in FIG. 6B, the pin 60 can be placed in any one of six positions each separated by an angle $\beta$ of 60°. In yet another example, using a splined mating pair having twenty splines around the circumferences of the engaging member 66 and the engaging formation 54 as shown in FIG. 6D, the pin 60 can be placed in any one of twenty positions each spaced apart by an angle $\beta$ of 18°. A skilled artisan can design a mating pair having any number of facets to obtain the desired angular spacing $\beta$ between positions of the pin 60 to achieve any desired amount of adjustability of the hinge 10. As discussed above, such shapes can include x-polygons and x-splines. Further, the engaging formation 54 can be generally circular, and the engaging member 68 can be generally circular with a flat adapted for being contacted by a set screw that is adjustable within the engaging formation 54.

A maximum pivoting angle $\alpha$ of the door 70 with respect to the door jamb 82 is set by placing the pin 60 at a desired angular position with respect to the second leaf 40. As shown in FIG. 5A, when the door is closed, the location of the pin 60 creates an opening or pivoting angle $\alpha$ between an edge 69 of the stop member 68 and the outer face 22 of the first leaf 20. Accordingly, as shown in FIG. 5B. when the door 70 is opened by pivoting first leaf 20 about the axis of the pin 60 away from the second leaf 40, the door 70 rotates until the edge 69 of the stop member 68 contacts the outer face 22 of the first leaf 20 such that the door 70 is prevented from pivoting further. When the outer face 22 is in contact with the stop member 68, the door 70 is at its maximum pivoting angle $\alpha$ for the particular placement of the pin 60 such that the angle between the inner faces 24, 44 of the first and second leaves 20, 40 is equal to $\alpha$. As depicted in FIGS. 5A and 5B, $\alpha$ is approximately 120°. However, the maximum pivoting angle α can be set to any desired opening angle.

Because of the ease with which the angular position of the pin 60, and thus the maximum pivoting angle α, can be adjusted, the setting of the pin position can be determined by actual measurements of the desired opening angle, or by trial and error. The setting can generally be accomplished with no tools, or at most, simple hand tools (e.g., a screw driver to raise the pin 60), and can be done by a homeowner or other end user of the hinge 10.

Figure 2:
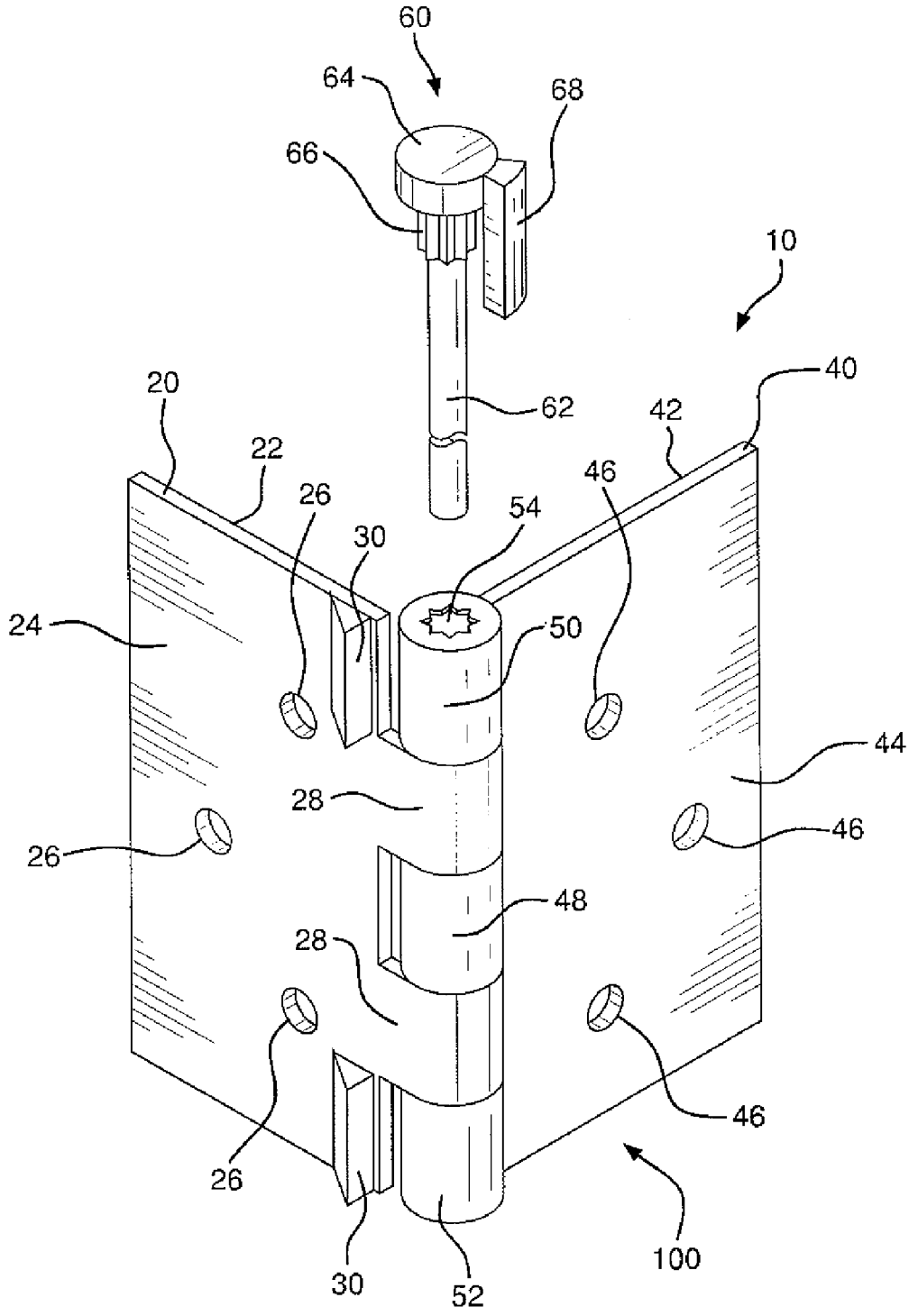
FIG. 2 is a partially exploded perspective view showing an embodiment of a loose-pin hinge with integral stop and a mating stop member on a hinge leaf.

FIG. 2 shows another embodiment of a loose-pin hinge 100. The hinge 100 is substantially similar to the hinge 10 of FIG. 1 except that the hinge 100 further includes at least one mating stop member 30 adjacent to the upper knuckle 50 adapted for cushioning the impact of the stop member 68 on the outer face 24 of the first leaf 20. The cushioning effect of the mating stop member 30 can also lessen the noise of impact between the first leaf 20 and the stop member 68. For a reversible hinge 100 (i.e., a hinge for use in either left-opening or right-opening arrangements) in which the upper knuckle 50 and the lower knuckle 52 each include an engaging formation 54, the mating stop member 30 can be provided adjacent to both the upper and lower knuckles 50, 52.

Figure 6A:
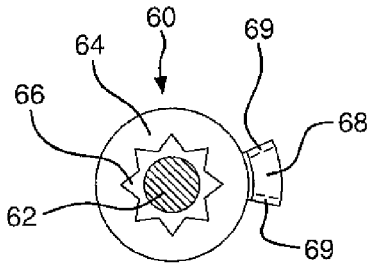
FIGS. 6A through 6F are partial cross-sectional bottom views of several embodiments of a hinge pin showing the pin shaft, the pin head, the pin engaging member, and the stop member as viewed from section 6-6 in FIG. 1.
Figure 6B:
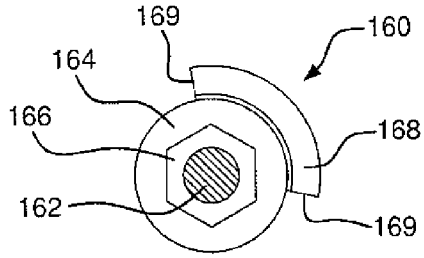
Figure 6C:
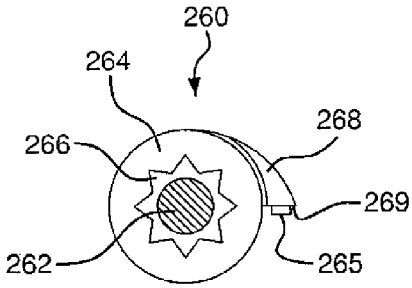
Figure 6D:
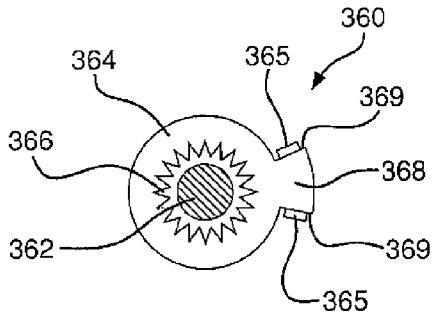
Figure 6E:
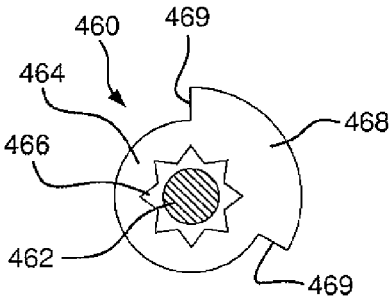
Figure 6F:
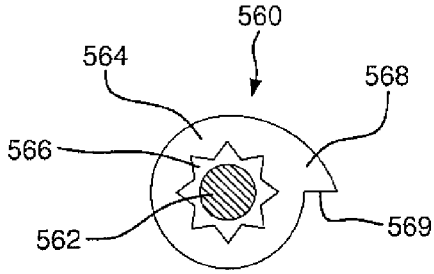

As can be seen from cross-sectional views of FIGS. 6A through 6F, the stop member 68 can vary in size and shape. For example, FIG. 6A shows a bidirectional stop member 68 that is symmetric with respect to a radius of the pin 60, while FIG. 6B shows a bidirectional stop member 168 that is also symmetric with respect to a radius of the pin 166 but spans a smaller angle than stop member 68 of FIG. 6A. FIGS. 6D and 6E also show bidirectional stop members 368 and 468, respectively. In another example, FIGS. 6C and 6F show a unidirectional stop member 268; alternatively a unidirectional stop member 268 could be made facing the opposite direction. In addition, the stop member 268 includes a bumper 265 for cushioning the impact between the first leaf 20 and the stop member 268. In yet another example, FIG. 6D shows a bidirectional stop member 368 including a bumper 365 on each edge. The bumpers 365 may wear more rapidly than other portions of the hinge pin 60 and can be made to be separately replaceable. The stops shown in FIGS. 6A through 6C extend radially outward from the respective pin heads and then downward along the length of the respective pin shanks, while the stops shown in FIGS. 6D through 6F extend only radially outward from the respective pin heads.

In any of the disclosed embodiments, the pin 60 can be manufactured as an integral unit or can be formed from two or more separate parts. Preferably, the pin 60 is cast, forged, or stamped out of a metallic material, including but not limited to a material comprising one or more of brass, steel, stainless steel, or aluminum. Alternatively, one or more parts of the pin 60 can be formed from material such as fiberglass, graphite, thermoplastic, polymer, or any other material having sufficient mechanical strength for the application. In one embodiment, the pin head 64 and engaging member 68 are integrally formed with the pin shank 62, and the stop member 68 is integrally formed with the pin head 64. In another embodiment, the pin head 64, the stop member 68, and the engaging member 66 are formed integrally with each other and are affixed to the pin shank 62 by a mechanical means known in the art, included but not limited to welding, brazing, or bolting. In some embodiments, the pin head 64 and the stop member 68 are integrally formed as a part that can be separately removed from the pin shank 62 and engaging member 66 so that the pin head 64 and stop member 68 can be replaced should the stop member 68 become damaged or broken. As in a conventional hinge, the entire pin 60 can always be removed and replaced, if desired.

In one embodiment of the loose-pin hinge 10, the edge 69 of the stop member 68 can be angled slightly or disposed at a slight angle such that the lower portion of the edge 69 is slightly farther from the first plate 20 than the upper portion of the edge 69, so that upon contact between the outer face 24 of the first plate 20 and the stop member 68, the impact of the contact helps to retain the pin 60 within the knuckles of the first and second plates 20, 40, rather than tending to force the pin 60 upward and out of the knuckles. For example, FIG. 6A shows an embodiment of the stop member 68 wherein the edges 69 are tapered such that the lower portion of the stop member 68 is slightly wider than the upper portion of the stop member 68. Such a configuration can help prevent the pin 60 from rising in the hinge 10, or creeping upward to cause possible problems or failure. In addition, in the embodiment as shown in FIG. 2, when a stop member 68 having a slightly angled edge 69 is used, the mating stop member 30 can include a corresponding slightly angled face for contacting the edge 69 of the stop member 68.

Figure 7:
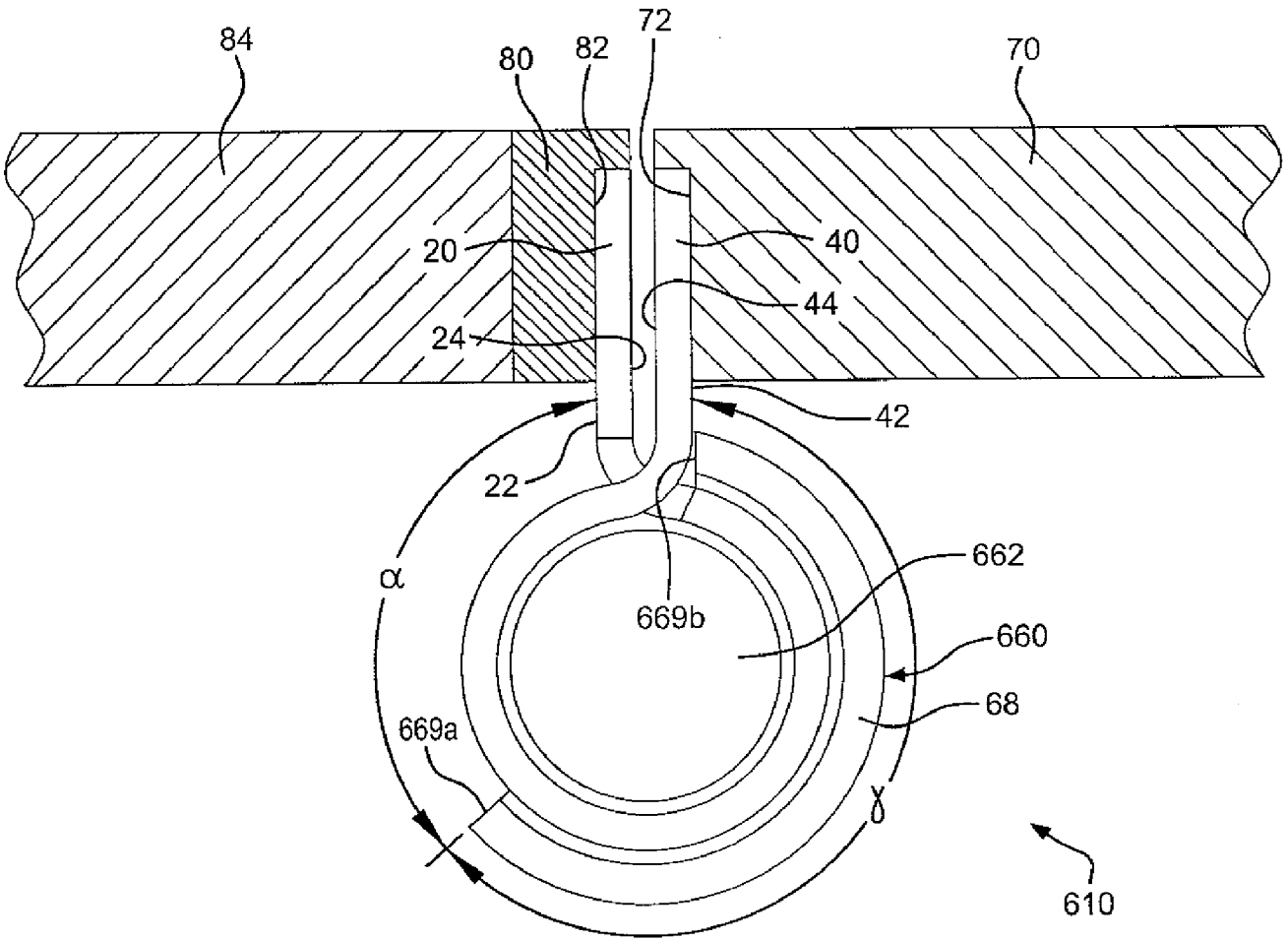
FIG. 7 is an expanded partial-cross sectional view of an alternate embodiment of a loose-pin hinge with integral stop with the door disposed in a closed position.

FIG. 7 shows an alternate embodiment of the loose-pin hinge 610 that does not require a mating engaging member and engaging formation combination. Rather, the pin 660 includes a stop member 668 that spans a stop member angle γ that is essentially complementary to the desired maximum pivoting angle α (taking into account, of course, the actual thickness of the first and second leaves 20, 40, as well as the spacing between the leaves 20, 40 when the door 70 is in a fully closed position). Accordingly, when the door 70 is opened to an angle α, an edge 669*a* of the stop member 668 contacts the outer face 22 of the first leaf 20 while an opposite edge 669*b* of the stop member 668 contacts the outer face 42 of the second leaf to prevent the door 70 from opening farther. In this embodiment, therefore, no mating engaging member and engaging formation are needed.

Figure 8A:
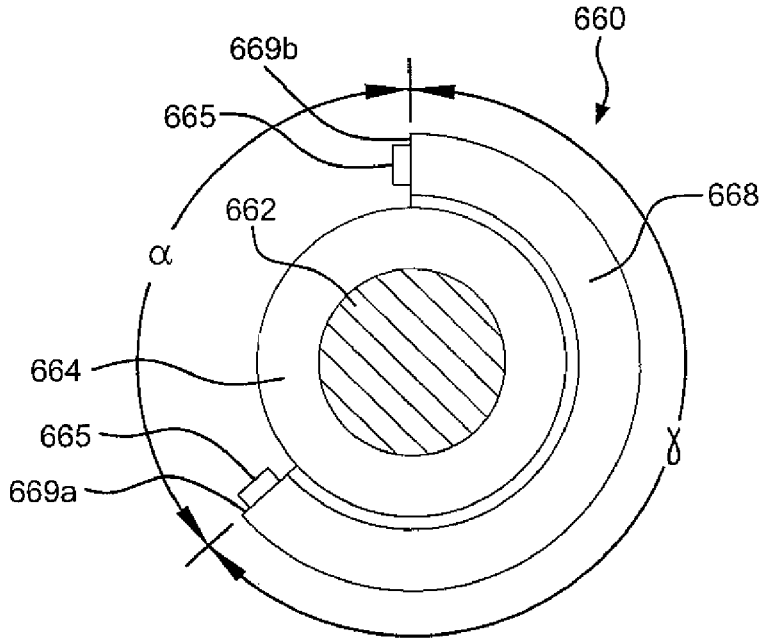
FIGS. 8A and 8B is a partial cross-sectional bottom views of alternate embodiment of a hinge pin showing the pin shaft, the pin head, and the stop member.
Figure 8B:
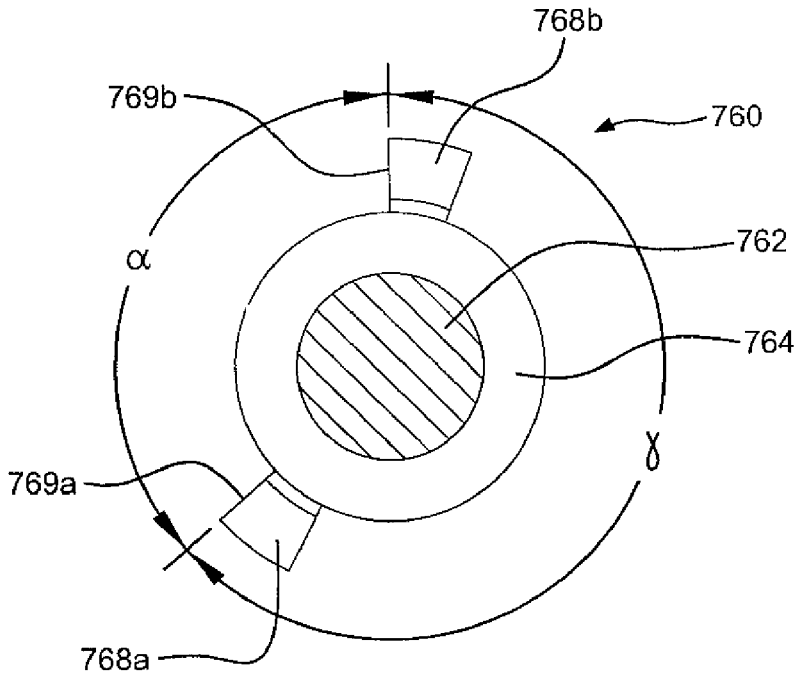

A bottom cross-sectional view of the pin 660 is shown in FIG. 8A. An alternative pin 760 for use in the loose-pin hinge 610 is shown in FIG. 8B, with two stop members 768*a* and 768*b* replacing the single stop member 668 of the pin 660 in FIG. 8A.

The desired angle of opening α can be varied by simply replacing the pin 660 with another pin 660 having a stop member 668 spanning a different stop member angle γ. Pins 660 can readily be made having stop members 668 in various increments spaced apart, for example, by increments of 2°, 5°, 10°, 15°, 24°, or any other number of degrees desired. The edges 669*a* and 669*b* can be angled to have slopes that cause the pin 660 to be retained in the knuckles, rather than being forced upward and out of the knuckles.

A method is also provided herein for limiting or restricting the angular amount by which a first hinged member may be pivoted relative to a second hinged member, wherein the first and second hinged members are pivotably connected by a loose-pin hinge 10 as disclosed herein. The desired opening angle between the hinged members can be set by attaching a first hinge leaf 20 to the first hinge member, attaching a second hinge leaf 40 to the second hinge member, and inserting the pin 60 including a stop member 68 into respective knuckles of the first and second leaves 20, 40 so that the engaging member 66 of the pin 60 engages with the engaging formation 54 of the upper knuckle 50 on the second leaf 40. The maximum pivoting angle can be adjusted by raising the pin 60 to disengage the engaging member 66 from the engaging formation 54, rotating the pin 60 to a desired position, and lowering the pin 60 to reengage the engaging member 66 with the engaging formation 54.

What is claimed:

1. A loose-pin hinge with integrated stop, comprising:

a first hinge leaf including a knuckle having a bore therethrough;

a second hinge leaf including a lower knuckle and an upper knuckle each having a bore therethrough, the lower knuckle and the upper knuckle being interdigitially mated with the knuckle of the first hinge leaf such that the bores of the knuckles are coaxially aligned; and a hinge pin including a shank, a head disposed at an upper end of the shank, and a stop member extending radially outward from the head, the shank of the hinge pin being received through the coaxially aligned bores of the knuckles to enable the first hinge leaf to pivot about the hinge pin with respect to the second hinge leaf, the stop member limiting the pivoting of the first hinge leaf to a maximum pivoting angle with respect to the second hinge leaf;

wherein the upper knuckle further comprises an engaging formation;

wherein the hinge pin further comprises an engaging member disposed along an upper portion of the shank;

wherein the engaging member of the hinge pin engages with the engaging formation of the upper knuckle to set an angular position of the hinge pin with respect to the second hinge leaf; and wherein the maximum pivoting angle is determined as a pivoting angle between the first hinge leaf and the second hinge leaf at which the stop member contacts the first hinge leaf.

2. The loose-pin hinge of claim 1, wherein the engaging member of the hinge pin has a male geometric shape and the engaging formation of the upper knuckle has a mating female geometric shape adapted to engagingly receive the male geometric shape of the engaging member, the geometric shape having x facets equally spaced about the circumference thereof to enable the hinge pin to be received through the knuckles in x angular positions to enable adjustment of the maximum pivoting angle in increments of (360/x)°.

3. The loose-pin hinge of claim 1, wherein the stop member has a sloped edge disposed at an angle effective to urge the hinge pin in a downward direction upon contact between the stop member and one of the first and second hinge leaves.

4. A loose-pin hinge with integrated stop, comprising:

a first hinge leaf including a knuckle having a generally cylindrical bore therethrough;

a second hinge leaf including a lower knuckle having a generally cylindrical bore therethrough and an upper knuckle having a bore therethrough, the upper knuckle further having an engaging formation, the lower knuckle and the upper knuckle being interdigitially mated with the knuckle of the first hinge leaf such that the bores of the knuckles are coaxially aligned; and a hinge pin including a shank, a head disposed at an upper end of the shank, an engaging member disposed along an upper portion of the shank, and a stop member extending radially outward from the head, the shank of the hinge pin being received through the coaxially aligned bores of the knuckles to enable the first hinge leaf to pivot about the hinge pin with respect to the second hinge leaf;

wherein the engaging member of the hinge pin engages with the engaging formation of the upper knuckle to set an angular position of the hinge pin with respect to the second hinge leaf; and wherein the stop member of the hinge pin limits the pivoting of the first hinge leaf to a maximum pivoting angle with respect to the second hinge leaf, the maximum pivoting angle being determined as a pivoting angle between the first hinge leaf and the second hinge leaf at which the stop member contacts the first hinge leaf.

5. The loose-pin hinge of claim 4, wherein the first hinge leaf has exactly two knuckles each having a generally cylindrical bore therethrough; and wherein the second hinge leaf has exactly three knuckles including the lower knuckle, the upper knuckle, and a middle knuckle having a generally cylindrical bore therethrough, the three knuckles of the second hinge leaf interdigitally mating with the two knuckles of the first hinge leaf such that the bores of the knuckles are coaxially aligned.

6. The loose-pin hinge of claim 4, wherein the engaging member of the hinge pin has a male geometric shape and the engaging formation of the upper knuckle has a mating female geometric shape adapted to engagingly receive the male geometric shape of the engaging member, the geometric shape having a number of facets equally spaced about the circumference thereof to enable the hinge pin to be received through the knuckles in a respective number of angular positions to enable adjustment of the maximum pivoting angle.

7. The loose-pin hinge of claim 6, wherein the geometric shape is an x-polygon having x number of facets, and wherein the maximum pivoting angle can be adjusted in increments of (360/x)°.

8. The loose-pin hinge of claim 6, wherein the geometric shape is an x-spline having x number of facets, and wherein the maximum pivoting angle can be adjusted in increments of (360/x)°.

9. The loose-pin hinge of claim 4, wherein the stop member further extends downwardly in an axially direction generally parallel to the shank.

10. The loose-pin hinge of claim 4, further comprising a bumper disposed on a surface of stop member for cushioning the impact of the stop member with the first hinge leaf.

11. The loose-pin hinge of claim 4, further comprising a mating stop member disposed on a surface of first hinge leaf for cooperating with the stop member in limiting the maximum pivoting angle.

12. The loose-pin hinge of claim 4, wherein the lower knuckle further includes an engaging formation adapted to engage with the engaging member of the hinge pin to enable the hinge to be installed in either a left-opening or a right-opening arrangement.

13. The loose-pin hinge of claim 12, wherein the stop member is bidirectional.

14. The loose-pin hinge of claim 4, wherein the stop member, the head, and the engaging member are integrally formed with the shank of the hinge pin.

15. The loose-pin hinge of claim 4, wherein the stop member has a sloped edge disposed at an angle effective to urge the hinge pin in a downward direction upon contact between the stop member and the first hinge leaf.

16. The loose-pin hinge of claim 4, wherein the stop member is unidirectional.

17. A method for limiting a hinge pivoting angle, the method comprising:

providing hinge comprising a first hinge leaf, a second hinge leaf, and a hinge pin, the first hinge leaf including a knuckle having a generally cylindrical bore therethrough, the second hinge leaf including a lower knuckle having a generally cylindrical bore therethrough and an upper knuckle having a bore therethrough, the upper knuckle further having an engaging formation, the lower knuckle and the upper knuckle being adapted to be interdigitially mated with the knuckle of the first hinge leaf such that the bores of the knuckles are coaxially aligned, the hinge pin including a shank, a head disposed at an upper end of the shank, an engaging member disposed along an upper portion of the shank, and a stop member extending radially outward from the head;

aligning an edge of the stop member with a desired maximum pivoting angular position of the first hinge leaf with respect to the second hinge leaf; and inserting the shank of the pin through the coaxially aligned bores of the knuckles so that the engaging member of the pin engages with the engaging formation of the upper knuckle at an angular position that retains the edge of the stop member nearest to the desired maximum pivoting angular position.

18. The method for limiting a hinge pivoting angle of claim 17, further comprising:

adjusting the maximum pivoting angular position of the first hinge leaf with respect to the second hinge leaf to be a new maximum pivoting angular position by:

withdrawing the shank of the pin from the coaxially aligned bores of the knuckles to disengage the engaging member of the pin from the engaging formation of the upper knuckle;

aligning the edge of the stop member with the new desired maximum pivoting angular position; and reinserting the shank of the pin through the coaxially aligned bores of the knuckles so that the engaging member of the pin engages with the engaging formation of the upper knuckle at a new angular position that retains the edge of the stop member nearest to the new desired maximum pivoting angular position.

* * * * *